US010392862B2

(12) United States Patent
Melittas

(10) Patent No.: US 10,392,862 B2
(45) Date of Patent: Aug. 27, 2019

(54) LIGHT BULB HOLDER

(71) Applicant: William S. Melittas, Glen Cove, NY (US)

(72) Inventor: William S. Melittas, Glen Cove, NY (US)

(73) Assignee: Gem Temp, LLC, Roslyn, NY (US)

( * ) Notice: Subject to any disclaimer, the term of this patent is extended or adjusted under 35 U.S.C. 154(b) by 0 days.

(21) Appl. No.: 15/106,390

(22) PCT Filed: Dec. 16, 2014

(86) PCT No.: PCT/US2014/070502
§ 371 (c)(1),
(2) Date: Jun. 20, 2016

(87) PCT Pub. No.: WO2015/095132
PCT Pub. Date: Jun. 25, 2015

(65) Prior Publication Data

US 2016/0340979 A1 Nov. 24, 2016

Related U.S. Application Data

(60) Provisional application No. 61/917,486, filed on Dec. 18, 2013.

(51) Int. Cl.

| | |
|---|---|
| ***E06C 7/14*** | (2006.01) |
| ***H01K 3/32*** | (2006.01) |
| ***H01J 9/00*** | (2006.01) |
| ***B25H 3/00*** | (2006.01) |

(52) U.S. Cl.
CPC ..... *E06C 7/14* (2013.01); *B25H 3/006* (2013.01); *H01J 9/003* (2013.01); *H01J 9/006* (2013.01); *H01K 3/32* (2013.01)

(58) Field of Classification Search
CPC .... E06C 7/00; E06C 7/14; H01J 9/006; H01J 9/003; H01K 3/32; B25H 3/006
USPC ..... 211/60.1, 70.8
See application file for complete search history.

(56) References Cited

U.S. PATENT DOCUMENTS

| | | | | |
|---|---|---|---|---|
| 2,911,133 A | | 11/1959 | Ruggieri | |
| 3,367,483 A | * | 2/1968 | Studen | B25H 3/003 206/379 |
| 3,696,920 A | * | 10/1972 | Lahay | A61B 50/20 128/DIG. 26 |
| 4,244,544 A | * | 1/1981 | Kornat | F16L 3/13 248/68.1 |
| 4,555,083 A | * | 11/1985 | Carter | B60P 7/12 224/403 |
| 4,613,042 A | | 9/1986 | Aeschliman | |

(Continued)

OTHER PUBLICATIONS

International Search Report and Written Opinion issued in International Application No. PCT/US2014/070502 dated Apr. 6, 2015.

*Primary Examiner* — Ko H Chan
(74) *Attorney, Agent, or Firm* — Hoffmann & Baron, LLP

(57) ABSTRACT

A light bulb holder including a bulb retaining body for holding a light bulb during installation of the bulb in a light fixture. The bulb retaining body generally includes an attachment member for removably or permanently affixing said retaining body to a ladder and at least one retaining slot unit supported on said attachment member including a base and opposed resilient fingers defining an opening for receiving a light bulb.

20 Claims, 10 Drawing Sheets

(56) References Cited

U.S. PATENT DOCUMENTS 4,714,162 A 12/1987 Harrison
4,779,914 A * 10/1988 Friedline ..... A47F 7/0028 211/198
4,858,763 A 8/1989 Scott
4,971,271 A * 11/1990 Sularz ..... A61M 5/1418 248/229.13
5,005,710 A * 4/1991 Hofer ..... B25H 3/04 206/373
5,292,013 A * 3/1994 Earl ..... H02G 3/263 248/224.61
5,542,535 A 8/1996 Dalton
D374,937 S 10/1996 Salas
D378,408 S * 3/1997 Pyeatt ..... D24/128
5,934,468 A 8/1999 Scott
5,979,102 A * 11/1999 Sagryn ..... A01K 97/08 114/364
6,502,664 B1 1/2003 Peaker, Sr.
7,438,265 B2 10/2008 Urzua
D587,102 S * 2/2009 Morgan ..... D8/356
7,513,471 B2 * 4/2009 Moufflet ..... A47F 5/0892 248/218.4
8,136,774 B2 * 3/2012 Melittas ..... H01K 3/32 248/210
8,162,156 B1 * 4/2012 Crisman ..... G10D 13/003 211/10
D685,501 S * 7/2013 Schildmeyer ..... D25/68
8,556,142 B2 10/2013 Kesan
8,757,399 B2 * 6/2014 Wolfbauer ..... A01K 97/08 211/60.1
9,808,573 B1 * 11/2017 Dooley ..... A61M 5/1418
2003/0132352 A1 * 7/2003 Weaver ..... A61G 7/0503 248/68.1
2010/0012804 A1 1/2010 Egan
2011/0203873 A1 8/2011 Perry
2014/0317990 A1 * 10/2014 Spiegel ..... A01K 97/10 43/21.2

* cited by examiner

LIGHT BULB HOLDER

CROSS-REFERENCE TO RELATED APPLICATION

This application claims priority to International Application No. PCT/US2014/070502 filed on Dec. 16, 2014, which claims the benefit of priority of provisional U.S. Patent Application No. 61/917,486 filed on Dec. 18, 2013, both of which are incorporated herein by reference in their entirety.

FIELD OF THE DISCLOSURE

The present disclosure relates generally to a device for aiding the process of installing or replacing light bulbs and, more particularly, to a holder permanently affixed or removably attachable to a ladder, for holding one or more light bulbs of any kind including incandescent and fluorescent light bulbs.

BACKGROUND

In the process of installing or replacing light bulbs, particularly fluorescent light bulbs, it is typically necessary to employ a stepladder in order to reach the elevated or overhead lamp fixture. Moreover, in settings such as in schools and office buildings, it has been a common practice for a custodian or serviceman to additionally carry a large carton or cartons containing incandescent and/or fluorescent light bulbs. Fluorescent light bulbs, in particular, are long, bulky and quite fragile and therefore, must be handled with great care.

One approach in replacing light bulbs involves placing the carton of light bulbs on the ground next to the stepladder and the person changing the lamps making numerous trips up and down the stepladder. Such a process is both tiresome to the person changing the lamps as well as very time consuming. Another drawback is the possibility of breakage due to either dropping the light bulb or hitting it against the stepladder during the numerous trips up and down the stepladder.

Thus, in many instances, two servicemen are utilized wherein a first person removes or replaces the light bulb from the fixture while standing on the ladder, and a second person transfers light bulbs to the person standing on the ladder. As can be appreciated, the use of two people to change light bulbs constitutes an inefficient use of labor. Another drawback is the possibility of breaking the light bulbs during handling between the two persons.

It has been known in the art to provide a device for temporarily holding one or more light bulbs whereby a person does not need to make numerous trips up and down a stepladder during the changing operation. For example, U.S. Pat. No. 4,858,763 to Scott discloses a light bulb holster in the form of a flexible bag having pockets to hold a plurality of tubular bulbs. A flap is utilized to cover the tops of the bulbs during transport and to secure the holster to a ladder brace at the work site.

U.S. Pat. No. 4,714,162 to Harrison shows a fluorescent light bulb holder including an upper and a lower bracket which are attachable to a ladder. The upper and lower brackets define pockets for loosely respectively retaining upper and lower portions of one or more fluorescent light bulbs.

U.S. Pat. No. 4,613,042 to Aeschliman discloses a plurality of tapered, rigid tubes of different lengths, integrally jointed together, such that a plurality of lamps can be held by the tubes at selected heights. The tubes may be clamped to one end of a stepladder using a vise-like mechanism.

While each of these devices includes features related to installations of light bulbs, each has its own drawbacks. For example, the flexible nature of the Scott light bulb holster does not afford much protection against breakage of the bulbs stored inside the holster. Breakage is also a concern with the Harrison device since the bulbs are loosely held in the pockets of this device and are not separated from one another. The Aeschliman device offers support for only a small portion of one end of the fluorescent light bulb, thereby exposing a large length of the fluorescent light bulb.

Another known light bulb holder, has recently been disclosed in U.S. Pat. No. 8,136,774 to Melittas, the specification of which is incorporated herein by reference in its entireties for all purposes. This particular light bulb holder includes a gripper unit for holding an elongate tubular light bulb during installation of the bulb in a light fixture. The gripper unit generally includes an attachment member for removably attaching the gripper unit to a ladder and at least one gripper supported on the attachment member. The gripper has opposed resilient fingers defining an opening for receiving a light bulb. The resilient fingers may be made from a pliable shape-retaining material and formed integral with the attachment member. Alternatively, the gripper has two fingers hinged together about a common pivot point. Preferably, the biasing element is a torsion spring and the gripper further includes a depressible button for urging the hinged fingers apart. In this regard, the button can include a cam structure cooperating with structure provided on the hinged fingers for urging the fingers apart.

The known gripper attachment member is preferably in the form of a bracket having a support face for supporting the gripper and two arms extending opposite the support face. The arms define a channel therebetween for attachment to the ladder and at least one arm preferably includes a hook extending inward into the channel from an end of the arm.

While this known light bulb holder does afford the user the benefit of aiding the process of installing light bulbs, it does not afford the user the same flexibility and ease of insertion and release of the bulbs as the disclosed light bulb holder. The user is generally required to exert some force either on a depressible button or similar mechanism for urging the hinged fingers apart so that the bulb can be inserted and secured once the button or similar mechanism is released. Therefore, some form of manual force is required to release the bulbs. Some form of manual force may be required to insert the bulb into the light bulb holder. Moreover, the known light bulb holder may be formed of materials that are generally of greater weight and requires more exertion for transport and use thereof.

Accordingly, it would be desirable to provide a device for temporarily holding one or more light bulbs that offers greater flexibility and ease of use, affords the user greater ease of use with the ability to easily insert and remove any type of light bulb from the holder while the user is installing or replacing light bulbs overhead. Moreover, it also would be desirable to provide a device that is easily transportable and lightweight, while also offering maximum protection to the bulbs in a convenient manner to the user.

Accordingly, it would also be desirable to provide a device that is permanently affixed to a stepladder, may be foldable into an open or closed position and offers greater flexibility and ease of use, yet also affords the user the ability to easily insert and remove any type of light bulb from the holder while the user is installing or replacing light bulbs overhead while using a stepladder.

SUMMARY

The present disclosure is a light bulb holder including a retaining body having at least one retaining slot unit for holding an elongate tubular light bulb or an incandescent light bulb during installation of the bulb in a light fixture. The retaining body generally includes an attachment member for removably or permanently affixing the retaining body to a ladder and at least one retaining slot unit supported on the attachment member. The retaining slot unit has opposed resilient retaining fingers defining an opening for receiving a light bulb.

The resilient fingers may be made from a pliable shape-retaining material and formed integral with the attachment member. At least two resilient fingers orthogonally extend from said base substantially parallel to each other.

In a preferred embodiment, the retaining slot unit has a first arcuate shaped finger and a second arcuate shaped finger, such that a gripping surface on each finger directly opposed to the gripping surface of the other finger end forms. The resilient fingers are spaced a distance from each other such that a light bulb may be inserted between the resilient fingers and squeezably retained between the gripping surfaces of the opposed resilient fingers. An attachment member on one end of the retaining body is provided which supports the retaining body for removable attachment to a ladder.

Preferably, the retaining body is formed of a foam material or similar foam-like material. The gripping surfaces of the retaining fingers form a slot having an arcuate shape for receiving a light bulb of any kind. The attachment member may also include at least one set of Velcro® fastener strips for adhering the light bulb hold to the ladder while also permitting convenient transport from one light fixture to another.

In yet another embodiment, the light bulb holder may further include a stiffener which extends substantially along an attachment side of the attachment member that is attached to the ladder. The stiffener may be one of a stiffener layer formed integrally with the attachment member or a separate strip permanently attached to the attachment member.

In yet another embodiment, the light bulb holder may further include two pivoting members or other protruding extensions for securing the holder to a stepladder through a hinged fastener or similar fastener affixed to the ladder. The holder in a preferred embodiment, may further include retaining slots formed by inner arcuate gripping surfaces such that a light bulb may be inserted between the resilient fingers and squeezably retained between the gripping surfaces of the opposed arcuate resilient fingers. In another embodiment, the holder may be rotated along an axis of rotation formed between the pivoting members and moved into a closed or an open position.

In yet another embodiment, an attachment member on one end of the retaining body is provided which supports the retaining body for removable attachment to a ladder. The ladder may further include a channel formed lengthwise along the length and/or width of the periphery of a portion of the ladder for insertion of the holder into a slot or channel defined by protruding extension along a periphery of the body of the ladder.

The preferred embodiments of the light bulb holder of the present disclosure, as well as other objects, features and advantages of this disclosure, will be apparent from the following detailed description, which is to be read in conjunction with the accompanying drawings.

DETAILED DESCRIPTION

Figure 1:
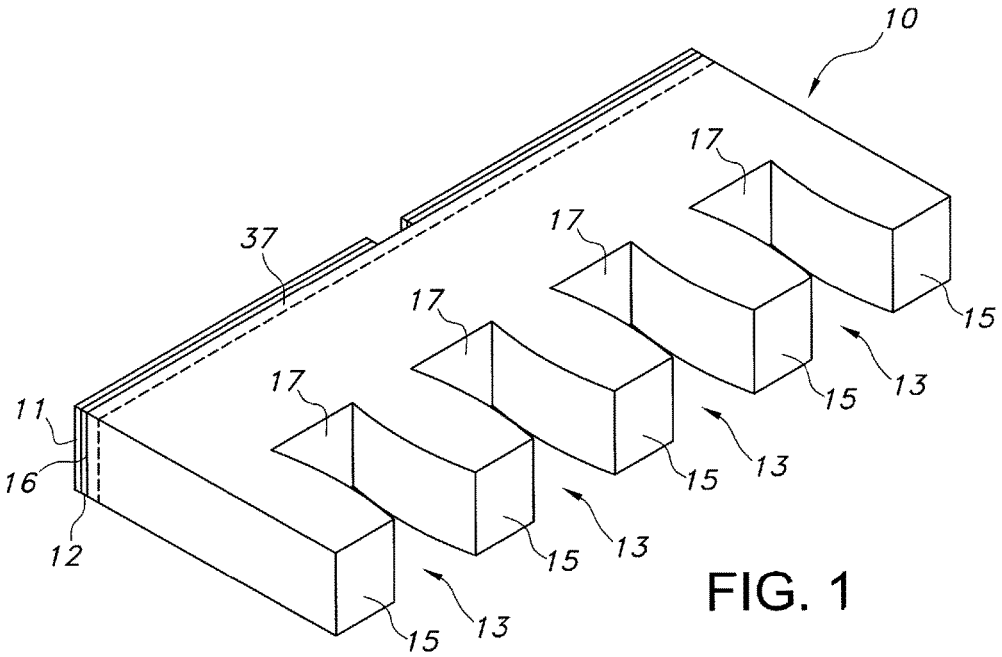
FIG. 1 illustrates a top perspective view of the light bulb holder in accordance with an embodiment of the present disclosure.
Figure 2:
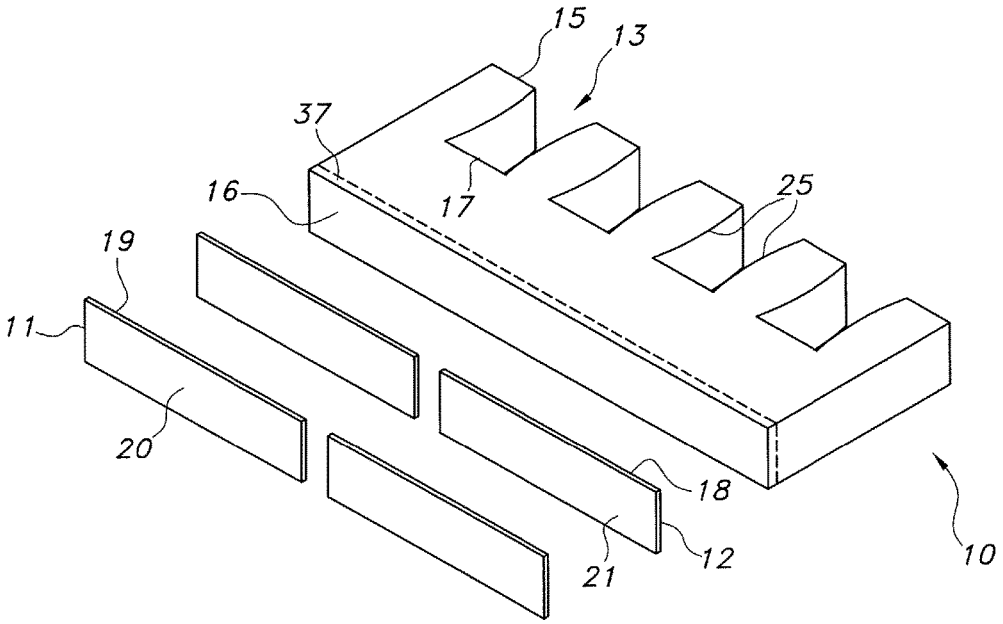
FIG. 2 illustrates an exploded perspective view of the light bulb holder shown in FIG. 1.

Referring first to FIGS. 1 and 2, a light bulb holder formed in accordance with the present disclosure is shown. While the present disclosure is particularly well suited for long tubular fluorescent light bulbs, it can be appreciated by those skilled in the art that the holder of the present disclosure can also be used with incandescent bulbs and/or compact fluorescent bulbs (CFLs).

The holder includes a bulb retaining body 10 generally with at least one retaining slot 13. The retaining body 10 can be removably attachable to the upper or middle portion of the side rails of a stepladder at side 14 of the body 10 using Velcro® fasteners having one strip sticky-back hook and the adjoining strip, loop fastener. Either the sticky-back hook or loop fastener side of the Velcro® strip may be adhered to the side rails of a stepladder using the adhesive side 20 of Velcro® strip 11. The remaining side of the Velcro® strip is adhered to end 16 of the body 10 using the adhesive side 18 of Velcro® strip 12. Either the sticky-back hook or loop fastener side of the Velcro® strip may form the surface of side 21 of strip 12 and side 19 of strip 11. The sticky-back hook surface fastens securely to the loop fastener surface.

Figure 3:
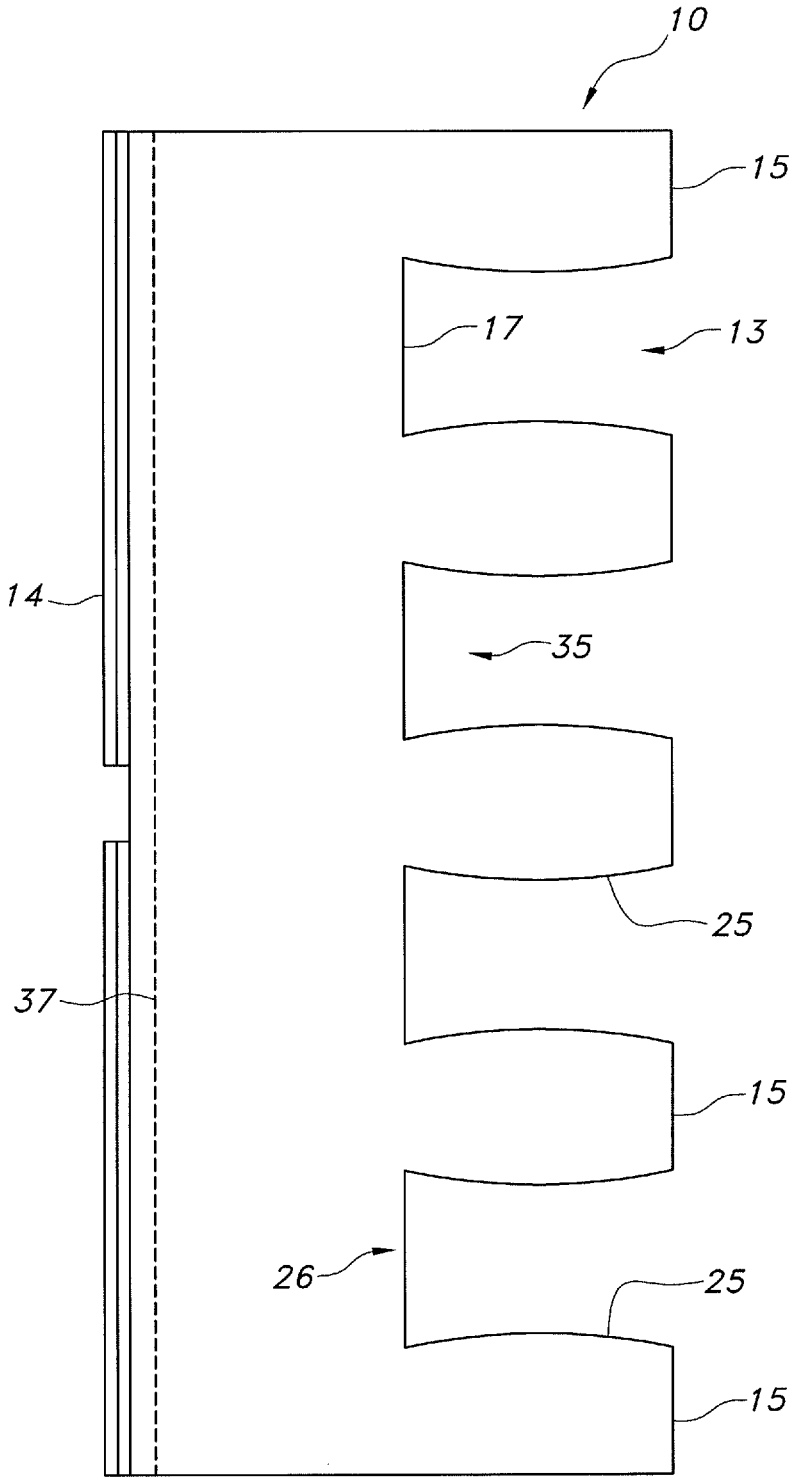
FIG. 3 illustrates an enlarged top plan view of the light bulb holder shown in FIG. 1.

Optionally, the body 10 can have a stiffener 37 as shown by the dotted line in FIGS. 1-3, which extends substantially along the attachment side 14. The stiffener 37 can be formed integrally as a layer part of the body 10; or can be a separate strip permanently attached to said body 10 after the formation of the body 10. The adhesive side 18 of the Velcro® strip 12 can then be attached to the stiffener 37.

The retaining slot 13 includes a retaining base 17 and at least two retaining fingers 15 that form an inwardly curved surface 25 for insertion therebetween of a bulb. The shape and space formed therebetween is at a distance sufficient to retain a fluorescent or incandescent light bulb or other kind of bulb that may be inserted therein. The material forming the retaining fingers 15 is sufficiently deformable and pliable such that the surfaces 25 squeeze against the surface of the bulb and retain it securely therebetween so as to prevent slippage of the bulb from the light bulb holder even in the event that the bulb might include a slippery film on its surface.

Referring additionally to FIG. 3, the retaining slot 13 can take the form of a unitary element 26 having two opposed arcuate retaining fingers 15 defining outwardly curved surfaces 25 with a space provided therebetween for squeezably receiving the light bulb. The body 10 may be made from a pliable foam or similar foam-like material which can deform somewhat yet tend to retain its shape so as to provide sufficient traction or squeezable force when a light bulb is inserted and held between the retaining fingers 15, thereby gripping the light bulb. Yet, the light bulb may be removed from the retaining slot 13 with ease and without requiring any great amount of exertion or force to slide out in either a radially outward, sideways or an upward direction from the body 10.

Figure 4:
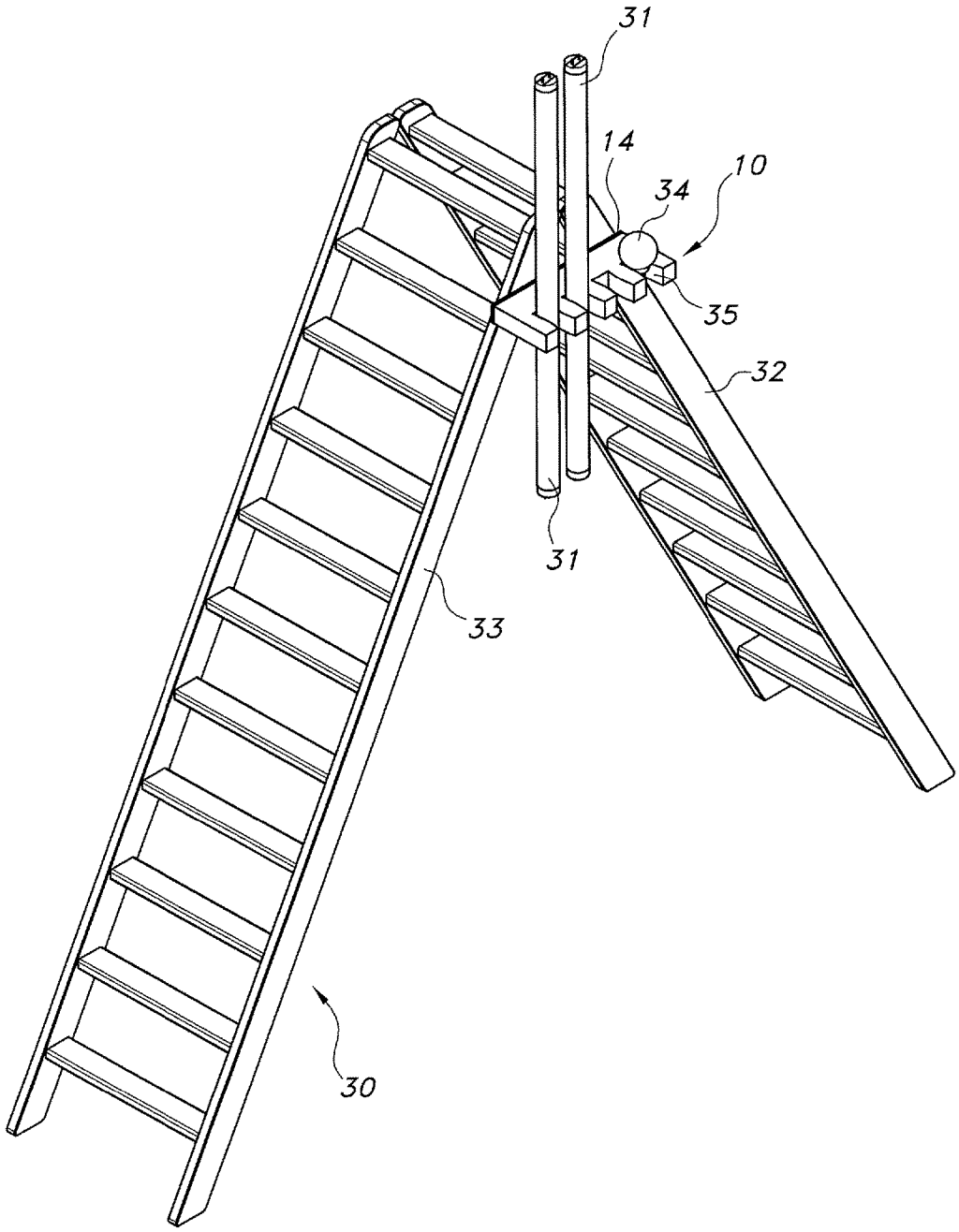
FIG. 4 illustrates a top perspective view of the light bulb holder in accordance with an embodiment of the present disclosure, attached to a ladder holding two fluorescent tubes and an incandescent bulb.

In a preferred embodiment, referring to FIG. 4, the body 10 may include up to four retaining slots 13. In use, the attachment side 14 can be positioned at a convenient location on the ladder 30 while the retaining fingers 15 of the retaining slot 13 can be deflected outward so as to permit the retaining body 10 to be securely adhered to the side rail 32 and/or side rail 33 of the ladder. The attachment side 14 includes Velcro® strip fasteners that are affixed thereto and used to adhere the body 10 to the side rail 32 and/or side rail 33 of the ladder 30.

It is further contemplated that various other adhering devices can be utilized with the holder to affix the holder to the ladder 30. For example, the attachment member 14 may include a threaded thumb screw, or other fastener, for securing the attachment member to the ladder. Similarly, the attachment member 14 may employ straps or other tie-down methods to fasten the holder via the attachment member 14 to the ladder 30. Accordingly, the disclosure is not limited to the Velcro® fasteners described in connection with the above figures.

Once the body 10 is affixed via the attachment side 14 by securing to the side rail 32 and/or side rail 33 of the ladder 30, a fluorescent light bulb 31 or incandescent light bulb 34 can be loaded in the retaining slot 13. This can be accomplished by sliding the bulb 31 or 34 downwardly or sideways by separating the retaining fingers 15 of the resilient retaining slot 13 and placing the bulb 31 into the opening 35 defined by the base 17 and retaining fingers 15. The retaining fingers 15 are then released somewhat whereby the resiliency of the resilient retaining slot 13 causes the fingers to return to their original position thereby squeezing around the circular periphery of the light bulb 31. The fluorescent light bulb 31 and/or incandescent light bulb 34 is thus safely and securely held by the retaining slot 13. The foam-like cushion material forming the body 10 and its retaining fingers 15 prevents damage to a light bulb 31 or 34 squeezably held between the retaining fingers 15 of the body 10. To remove the light bulb 31, the bulb may simply be pulled radially outwardly from the retaining slot 13 whereby the retaining fingers 15 are gently urged apart to release the bulb and retain their shape upon removal of the bulb.

Figure 5:
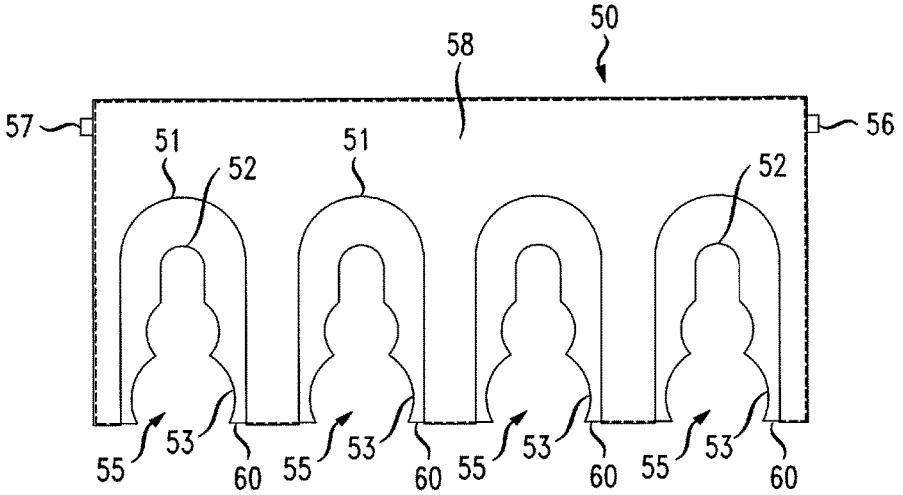
FIG. 5 illustrates a top view of the light bulb holder in accordance with yet another embodiment of the present disclosure.
Figure 7:
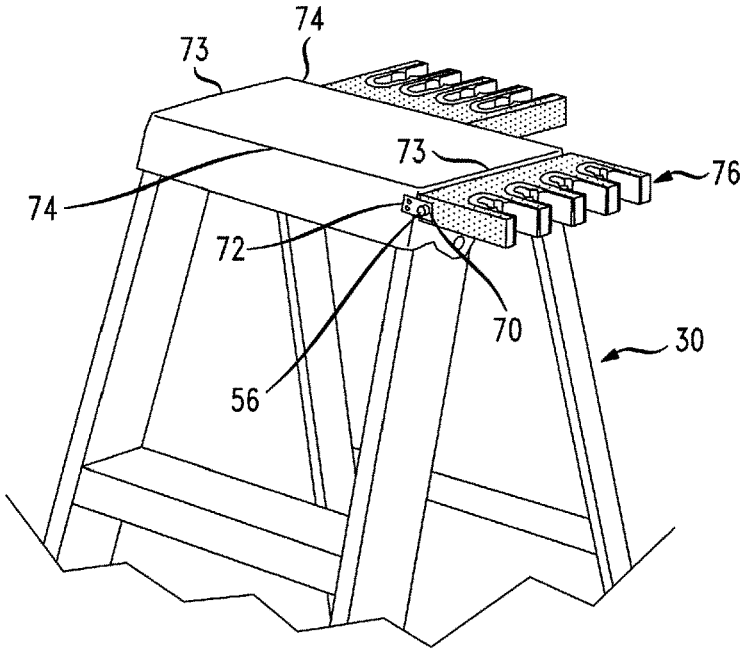
FIG. 7 illustrates a top perspective view of the light bulb holder shown in FIG. 5 affixed to a step ladder in an open position for receiving light bulbs.

Referring to another embodiment of the holder as shown in FIG. 5, the retaining slot 55 can take the form of a unitary element 51 having an outer elongated semi-circular layer surrounding inner semi-arcuate shaped surfaces 52. The inner surfaces 52 of the unitary element 51 define semi-arcuate curved retaining surfaces 53 with semi-arcuate spaces 55 provided therebetween for squeezably receiving and retaining the light bulb. The body 50 including the inner body 58, may be made from a pliable foam, semi-hard rubber or similar foam-like material which can deform somewhat yet tend to retain its shape so as to provide sufficient traction or squeezable force when a light bulb is inserted and held between the retaining surfaces 53, thereby gripping the light bulb. Yet, the light bulb may be removed from the retaining slot 55 with ease and without requiring any great amount of exertion or force to slide out in either a radially outward, sideways, downward or an upward direction from the body 50. The holder includes protruding projections (56, 57) on both sides, having a size and shape suitable for cooperatively fitting into a receiving notch 70 as shown in FIG. 7, being thereby affixed to a stepladder 30 and being removable therefrom as well. In certain embodiments, the protruding projections or shafts (56, 57) may act as pivoting members having an axis of rotation that extends coaxially therebetween, thereby permitting pivoting of the holder including in an upward rotation of 90° from its closed position 75 shown in FIG. 8 into an open position 76 as shown in FIG. 7.

Figure 8:
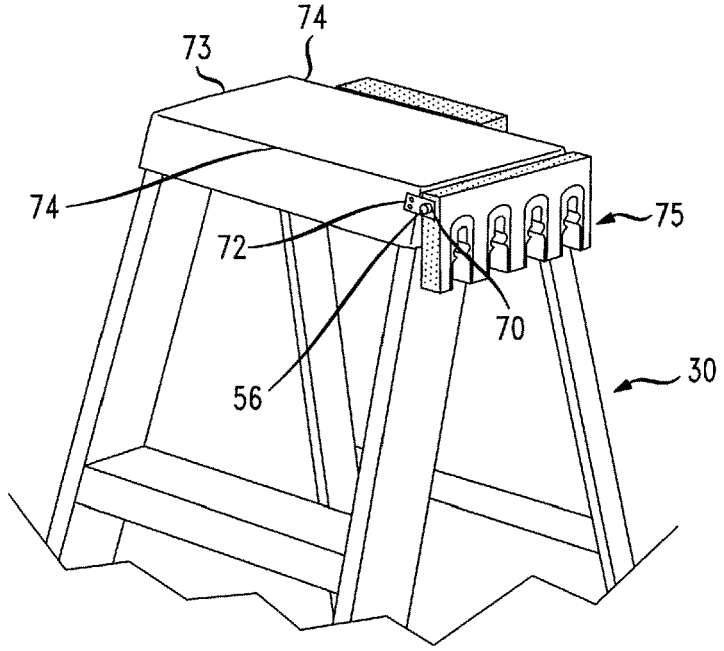
FIG. 8 illustrates a top perspective view of the light bulb holder shown in FIG. 5 as affixed to a step ladder and in a folded position.

In its open position 76, the holder extends coextensively with the periphery of the top portion of the ladder 30 on either or opposing sides of the ladder (73, 74) as shown in FIG. 7. The holder may also be rotated downward 90° about the axis of rotation formed between pivoting members or shafts (56, 57) and folded into a closed position 75 as shown in FIG. 8. The holder is affixed and attached to the receiving notch 70 located on both sides of the holder. The holder may be permanently affixed at shafts 56 and 57. The shafts 56 and 57 have a size and shape suitable for cooperatively fitting into a hinge member 72 having a receiving notch 70. The holder may be removed from the ladder 30 by removal of the hinge member (72) from the shafts 56 and 57.

Figure 6:
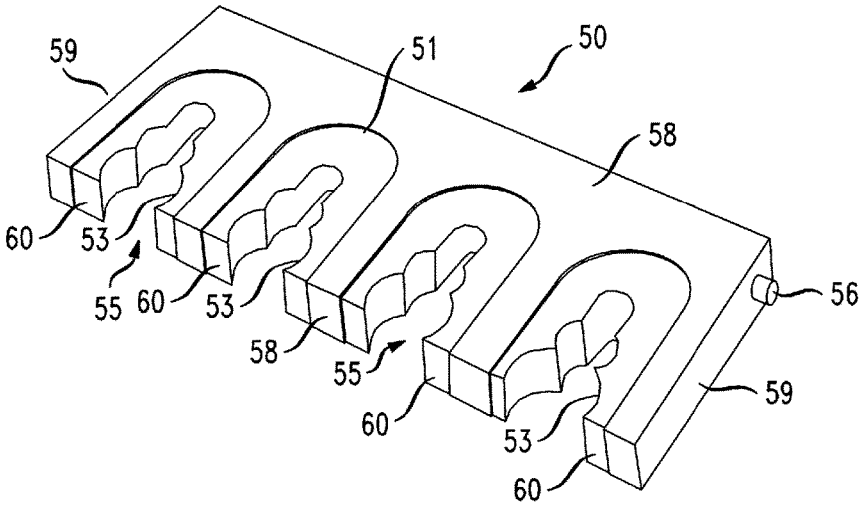
FIG. 6 illustrates a top perspective view of the light bulb holder shown in FIG. 5.

FIG. 6 is a perspective top view of the embodiment of the holder shown in FIG. 5 including a perspective view of the inner surfaces 53 of the semi-arcuate retaining walls 60 forming the retaining slot 55 for receiving and retaining the light bulb(s). The body, 50 including the inner body 58, may be made from a pliable foam, semi-hard rubber or similar foam-like material which can deform somewhat yet tend to retain its shape so as to provide sufficient traction or squeezable force when a light bulb is inserted and held between the retaining surfaces 53 of the retaining fingers or walls 60, thereby gripping the light bulb. The holder, particularly the inner body 58 may be formed of plastic, semi-hard rubber durable foam-like material or similar material that wraps around the retaining fingers 60, thereby supporting and adjoining the retaining walls 53.

The body 50 of the holder may include up to four retaining slots 55. In use, the attachment side 59 can be positioned at a convenient location on the ladder 30 and the retaining walls 53 of the retaining slot 55 can be deflected outward so as to permit the body 50 to be securely adhered to the side rail 32 and/or side rail 33 of the ladder. As described above for FIGS. 5 and 6, the shafts 56 and 57, located on either attachment side 59 of the body 50, can be affixed to the stepladder 30 and rotated into an open position 76 as shown in FIG. 7 or alternatively rotated or pivoted about the axis of rotation into a closed position 75 as shown in FIG. 8. The shafts or protruding projections 56 and 57 are cooperatively fitted for example, in a circumferentially fitted fashion into the hinge members 72 through the receiving notch 70 on the attachment sides 59 of the holder.

Figure 9:
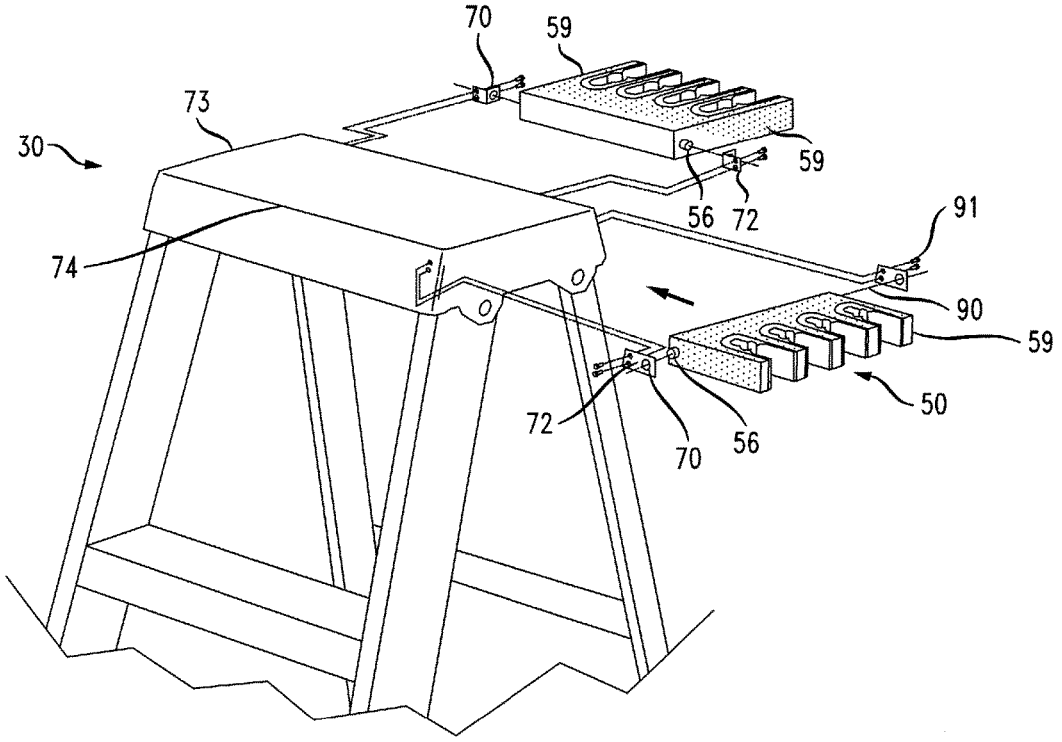
FIG. 9 illustrates an exploded perspective view of the light bulb holder shown in FIG. 7.

Turning to FIG. 9, shown is an exploded view of the holder shown on either side of the ladder 30, along its periphery, length 74 or width 73. The attachment members including the hinge members 72, attach to the ladder 30 for example, using attaching elements such as for example, male threaded screws 91. The body 50 may attach to the ladder 30, on its attachment side 59 with protruding elements or shafts 56 cooperatively fitting through the receiving notch 70 and being affixed to the ladder, while also permitting pivotal rotation of the body 50 about an axis of rotation 90. The holder may be rotated either 90° downward into a closed position 75 as shown in FIG. 8 or rotated 90° upward into an open position 76 as shown in FIG. 7.

It is further contemplated that various other attaching elements can be cooperatively implemented with the holder to affix the holder to the ladder 30 either permanently or removably. For example, the attachment member may be affixed to attachment side 59 by using a threaded thumb screw, male thread screw, thread wrapped around a cylinder, bolt or other fastener, thereby securing the attachment member to the ladder. Accordingly, the disclosure is not limited to the fasteners described above.

Figure 10:
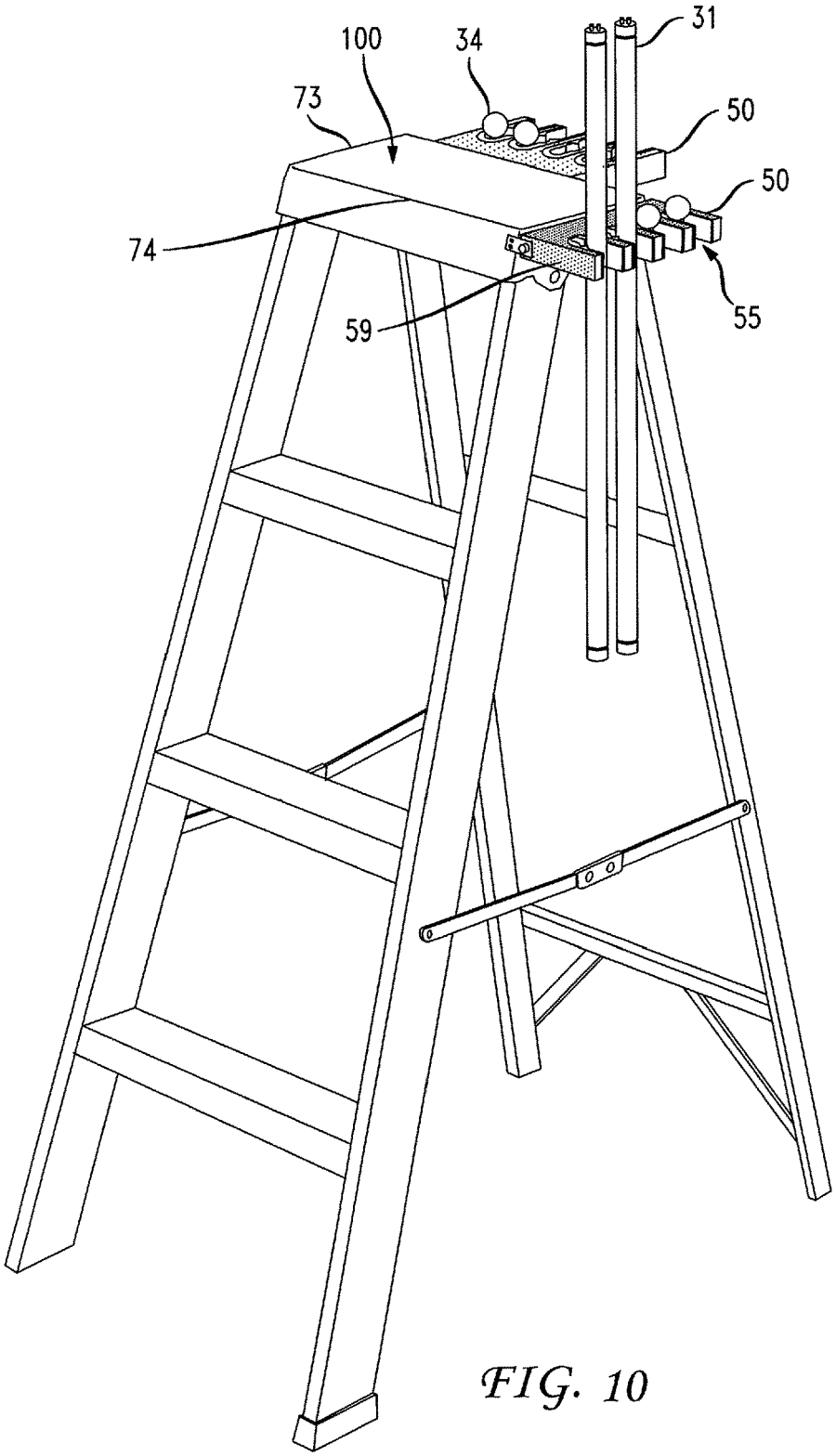
FIG. 10 illustrates a top perspective view of the light bulb holder shown in FIG. 7 retaining tubular fluorescent and other light bulbs.
Figure 11:
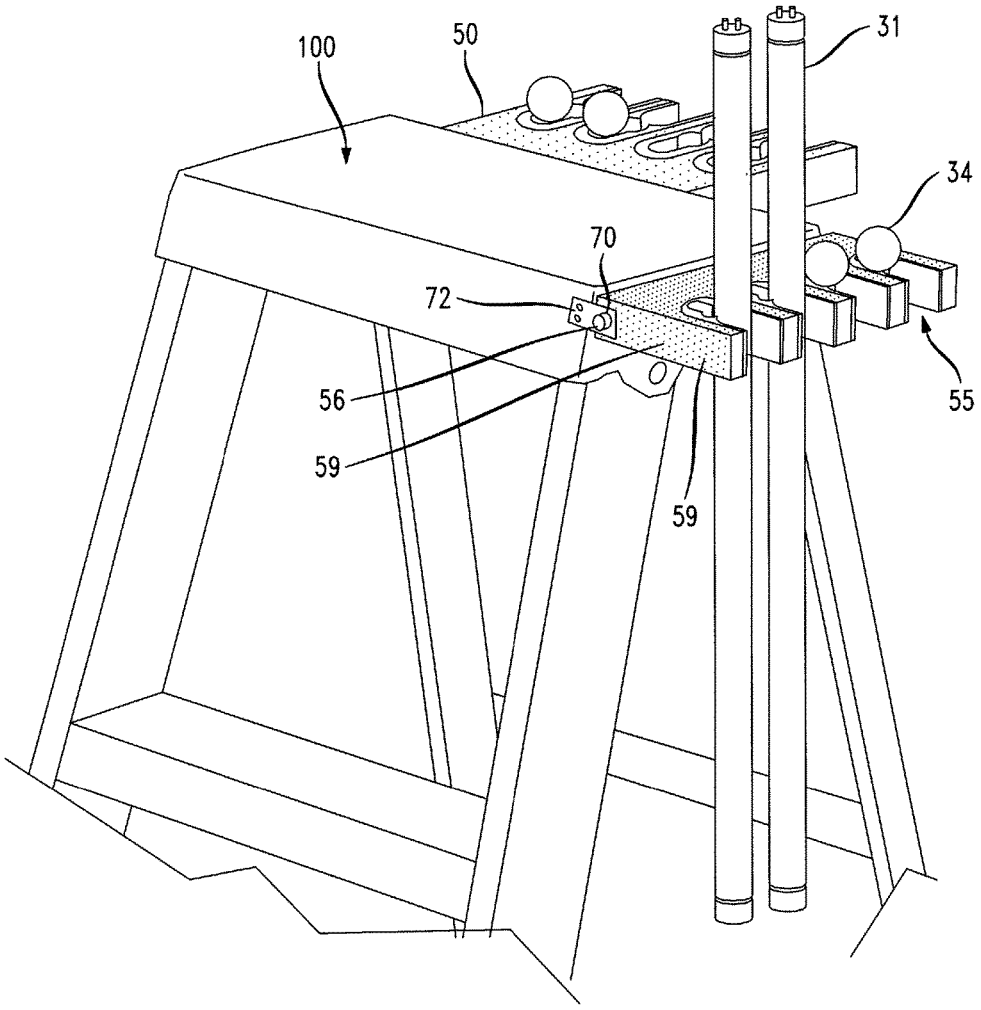
FIG. 11 illustrates an enlarged perspective view of the light bulb holder shown in FIG. 10.

Turning to FIG. 10, once the body 50 is affixed via the attachment sides 59 by being secured to the periphery of the top portion 100 of the ladder 30 either lengthwise 74 and/or along the width 73 of the ladder 30, a fluorescent light bulb 31 or incandescent light bulb 34 can be loaded in the retaining slot 55. This can be accomplished by sliding the bulb 31 or 34 downwardly or sideways by separating the retaining members or fingers 60 of the resilient retaining slot 55 and placing the bulb 31 into the opening 55 defined by the semi-arcuate perimeters of retaining walls 60 and inner retaining wall surfaces 53 as shown in FIG. 5. The fluorescent light bulb 31 and/or incandescent light bulb 34 is thus safely and securely held by the retaining slot 55. The material forming the body 50 and its retaining walls 53 prevent damage to a light bulb 31 or 34 squeezably held between the retaining walls 53 of the body 50. As already described, in order to remove the light bulb 31 from the holder, the bulb may simply be pulled radially outwardly from the retaining slot 55 whereby the retaining fingers 60 are gently urged apart to release the bulb and retain their shape upon removal of the bulb. FIG. 11 is an enlarged view of FIG. 10 including attachment element, for example, a hinge 72 secured to body 50 on both attachment sides 59 of holder with shaft or protruding extension 56 shown cooperatively and circumferentially fitting into a female receiving notch 70. The shaft 56 in certain embodiments may also act as a pivoting member.

Figure 12:
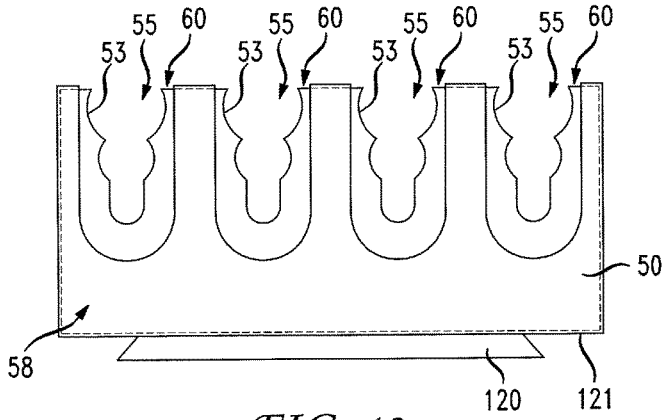
FIG. 12 is a top view of the light bulb holder including an attachment member for insertion into a slot in the periphery of the top of the ladder in accordance with another embodiment of the present disclosure.

Yet another embodiment is shown in FIG. 12, including an attachment plate member 120 that is attached to and extends upward either obliquely or perpendicular to the attachment side 121 of the body 50. The attachment plate member 120 may extend from the attachment side 121 and be separately attached or may be formed as an integral part of the holder which includes a shape that cooperatively fits into the receiving slots 122 of the top portion 100 of the ladder as shown for example, in FIG. 13. As described above and shown in FIG. 6, the holder, particularly the inner body 58 of the holder, may be formed of material such as plastic, semi-hard rubber, durable foam-like material or similar material that wraps around the retaining fingers 60 supporting and adjoining the retaining walls 53 that form retaining slots 55.

Figure 13:
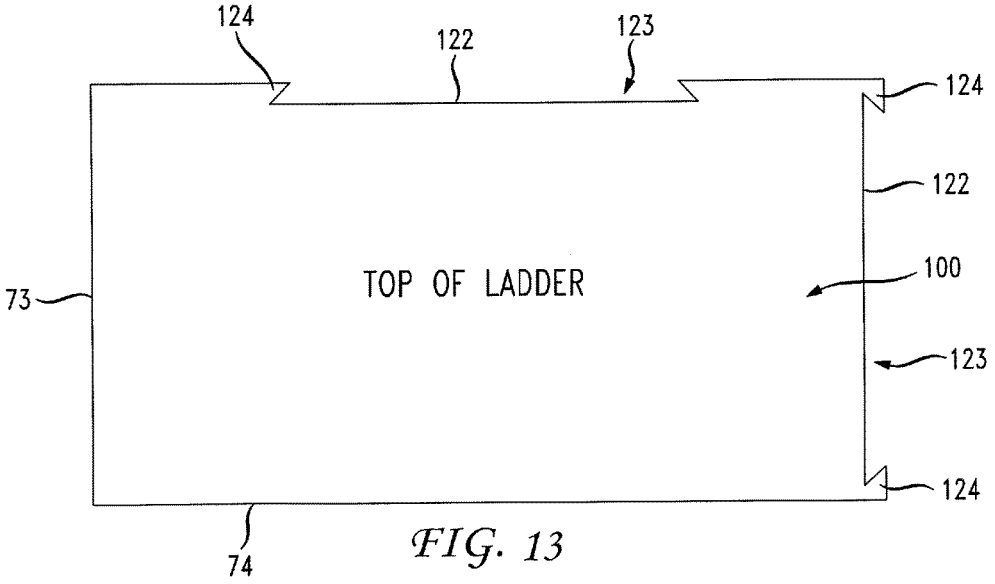
FIG. 13 illustrates a top view of the ladder including slots along its periphery for receiving the light bulb holder as shown in FIG. 11.

Cooperatively aligned with the embodiment of the holder of FIG. 12, is the top of the stepladder 100 as shown in FIG. 13 which includes at least one elongated opening formed along the periphery shown as slot 122. In certain embodiments, additional slots 122 may be formed along the periphery of the top 100 of the ladder adjacent its width 73 and/or length 74 at either, opposing or both sides of the ladder and possibly, along the entire perimeter of the top 100. The slots 122 are formed by two outwardly extended shaped projections 124 forming a channel 123 therebetween, for receiving and securely fastening the attachment plate 120 of the body 50 to the top 100 of the ladder. The channel 123 is formed for delivery of the attachment plate 120 between the outer surface of the body of the ladder and said extended shaped projections 124. In certain embodiments, the holder may be removable from the channel 123. In other embodiments, the holder may permanently affixed to the ladder via the channel 123 using adhesive materials, for example Velcro® attachment or other adhesive material(s) on the surface of the attachment plate 120 or using other types of fasteners.

Figure 14:
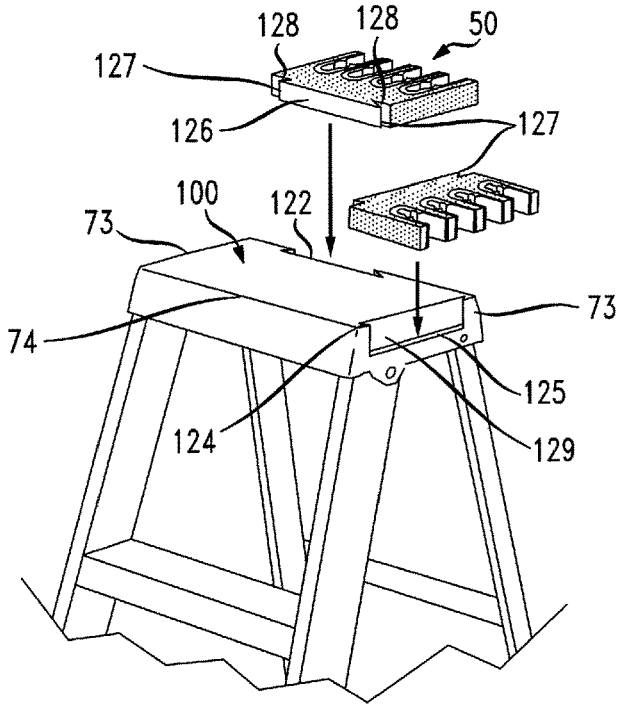
FIG. 14 illustrates an exploded perspective view of an embodiment of the light bulb holder for retaining in slot(s) formed along the periphery of the stepladder.
Figure 15:
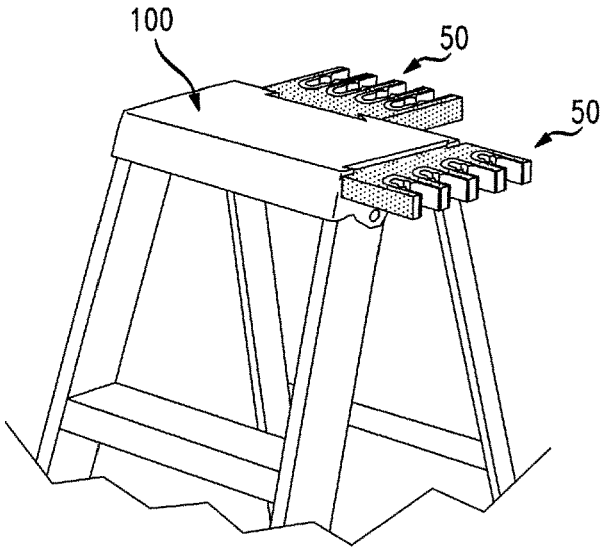
FIG. 15 illustrates a top perspective view of the light bulb holder(s) shown in FIG. 14 retained along the periphery of the stepladder.

FIG. 14 shows an embodiment of the holder having a body 50 with the top portion of the ladder 100 having openings on one or more sides that extend along one or more edges of the ladder portion 100 so as to securely retain the body 50 along the periphery of the ladder and adjacent to at least one side, shown as width 73 and/or length 74. The holder(s) 50 may be inserted into the slot 122 formed by two outwardly extended shaped projections 124 forming a channel 129 therebetween for receiving and securely fastening the attachment member 126 of the body to the top portion 100 of the ladder. In the shown embodiment, the attachment member 126 is formed integral to the body 50 of the holder. The attachment member 126 includes two outwardly extended shaped projections 127 forming a channel 128 therebetween. The attachment member 126 cooperatively fits into the space formed by channel 129. The attachment member 126 is formed for ease of insertion into the channel 129 and correspondingly, removal of the holder from the top portion 100 of the ladder from the space or channel 129 formed along the periphery of the top portion 100. In addition, the channel 129 may include a ridge surface 125 formed at the base of the channel 129, upon which the holder may be supported once inserted therein. As shown in FIG. 15, the body as inserted into the channel 129, is supported by the ridge surface 125 at the adjoining surfaces of the attachment member 126 and cooperatively fitted in the channel 129 formed in the periphery of the ladder top portion 100 as shown in FIG. 14. In the shown embodiment, the holder may be removed from the channel 129 by slideable movement in an upward direction. It is further contemplated that the slot or channel 128 formed in the top portion of the ladder 100 may also or alternatively be formed in other portions of the body of the ladder that supports the attachment member 126 of the holder.

As a result of the present disclosure, a simple device is provided for safely and securely holding incandescent and/or fluorescent light bulbs during bulb installation or replacement in light fixtures. The device is lightweight and easily attachable to a stepladder and is therefore, conveniently transportable from one light fixture to another in certain embodiments. In other embodiments, the device may be permanently affixed to a step ladder and thus, permanently and conveniently available to the user of the step ladder.

Although preferred embodiments of the present-disclosure have been described herein with reference to the accompanying drawings, it is to be understood that the disclosure is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A light bulb holder comprising a retaining body including:

an attachment member for flexibly attaching said retaining body transversely to at least one side portion of a ladder; and at least one retaining slot unit supported on said attachment member, said retaining slot unit having a base and opposed resilient fingers defining an opening slot for receiving a light bulb of various sizes, said opposed resilient fingers being flexible and extending orthogonally from said base substantially parallel to each other, said resilient fingers comprising multiple semi-arcuate contours of opposing curvature, the resilient fingers being sufficiently spaced a distance apart from each other for retaining the light bulb of any shape therebetween, such that a pliable gripping surface associated with each finger is directly opposed to the gripping surface of an other opposing finger, multiple light bulbs capable of being received between other pairs of fingers and securely retained vertically between said gripping surfaces of an other opposed resilient finger of the other pairs, the light bulb holder capable of being rotated into an open position for receiving and retaining the light bulbs, and a closed position when the light bulbs are removed.

2. The light bulb holder as defined in claim 1, wherein said resilient fingers are made from a pliable shape-retaining material.

3. The light bulb holder as defined in claim 2, wherein said resilient fingers are formed integral with said attachment member.

4. The light bulb holder as defined in claim 2, wherein at least one of said gripping surfaces has an arcuate shape.

5. The light bulb holder as defined in claim 4, wherein both said gripping surfaces of said fingers form said retaining slot unit having an arcuate shape.

6. The light bulb holder as defined in claim 1, wherein said attachment member includes at least one set of Velcro fastener strips for adhering the light bulb holder to the ladder.

7. The light bulb holder as defined in claim 1, which further comprises a stiffener which extends substantially along an attachment side of said attachment member that is attached to said ladder.

8. The light bulb holder of claim 7, wherein said stiffener is one of a stiffener layer formed integrally with said attachment member or a separate strip permanently attached to said attachment member.

9. A light bulb holder comprising a retaining body including:

an attachment member for attaching said retaining body transverse to at least one side portion of a ladder via a hinge attachment, the retaining body capable of being pivoted into various degrees of rotation; and at least one retaining slot unit supported on said retaining body and having a supporting portion, said retaining slot unit having opposed resilient fingers defining an opening for receiving a light bulb of various sizes, each pair of resilient fingers being flexible and extending orthogonally from said base defining inner semi-arcuate contoured surfaces, the pair of resilient fingers are of opposing semi-arcuate contoured surfaces and sufficiently spaced a distance from each other such that a pliable gripping surface associated with each finger is directly opposed to the gripping surface of an other opposing finger of the pair of the resilient fingers, so that the light bulb inserted between said pair of the resilient fingers is received and securely retained vertically between said gripping surfaces of the opposed resilient finger of the pair, the light bulb holder capable of receiving and retaining multiple lights bulbs when pivoted in an open position at the various degrees of rotation, and pivoted into a closed position when the light bulbs are removed.

10. The light bulb holder as defined in claim 9, wherein said resilient fingers are made from a pliable shape-retaining material.

11. The light bulb holder as defined in claim 9, wherein said resilient fingers are formed integral with said attachment member.

12. The light bulb holder as defined in claim 9, wherein at least one of said gripping surfaces has an arcuate shape.

13. The light bulb holder as defined in claim 12, wherein both said gripping surfaces of said fingers form said retaining slot having an arcuate shape.

14. The light bulb holder as defined in claim 1, wherein said light bulb is one of an incandescent light bulb, and a fluorescent light bulb.

15. The light bulb holder as defined in claim 9, wherein said attachment member further comprises at least two protruding extensions for cooperatively fitting into a receiving notch of an attachment member affixed to the ladder.

16. The light bulb holder as defined in claim 15, which further comprises rotating the holder about an axis of rotation formed between at least two pivoting members, the rotating being performed by pivotal movement of the protruding extensions cooperatively fitted into receiving notches of attachment members affixed to the ladder.

17. The light bulb holder of claim 16, wherein the holder is rotated 90° in an upward direction from a closed position into an open position.

18. The light bulb holder of claim 16, wherein the holder is rotated 90° in a downward direction from an open position to a closed position.

19. The light bulb holder of claim 17, wherein a light bulb is inserted into the retaining slot unit and securely retained while rotated in the open position.

20. The light bulb holder of claim 9, wherein the attachment member is cooperatively fitted into an attachment channel of the ladder for removable attachment of the holder to the ladder, the holder being rotatable from a closed position to an open position, and vice versa.

* * * * *